US008169283B2

(12) United States Patent
Siebels et al.

(10) Patent No.: US 8,169,283 B2
(45) Date of Patent: May 1, 2012

(54) CIRCUIT BREAKER TRIP UNIT SUPPORT

(75) Inventors: Randall L. Siebels, Cedar Rapids, IA (US); Gary A. Volesky, Newhall, IA (US)

(73) Assignee: Schneider Electric USA, Inc., Palatine, IL (US)

( * ) Notice: Subject to any disclaimer, the term of this patent is extended or adjusted under 35 U.S.C. 154(b) by 241 days.

(21) Appl. No.: 12/716,834

(22) Filed: Mar. 3, 2010

(65) Prior Publication Data

US 2011/0216480 A1 Sep. 8, 2011

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 9/02*** | (2006.01) |
| ***H01H 13/04*** | (2006.01) |

(52) U.S. Cl. ..... 335/202; 335/8

(58) Field of Classification Search ..... 335/8, 202
See application file for complete search history.

(56) References Cited

U.S. PATENT DOCUMENTS

| | | | | |
|---|---|---|---|---|
| 4,939,437 | A | 7/1990 | Farag et al. | |
| 5,379,013 | A | 1/1995 | Coudert | |
| 5,831,498 | A | 11/1998 | Maloney et al. | |
| 6,781,491 | B2 * | 8/2004 | Whipple et al. | 335/202 |
| 6,930,577 | B2 * | 8/2005 | Subramanian et al. | 335/202 |
| 7,130,173 | B2 | 10/2006 | Barewz | |
| 2003/0068923 | A1 | 4/2003 | Feller et al. | |
| 2005/0057333 | A1 * | 3/2005 | Subramanian et al. | 335/202 |
| 2009/0190289 | A1 | 7/2009 | Bellotto et al. | |

FOREIGN PATENT DOCUMENTS

| | | | |
|---|---|---|---|
| FR | 2513008 | A1 | 3/1983 |
| WO | WO92/08559 | A1 | 5/1992 |

OTHER PUBLICATIONS

Written Opinion corresponding to International Patent Application No. PCT/US2011/026845, European Patent Office, dated May 16, 2011, 7 pages.

International Search Report corresponding to International Patent Application No. PCT/US2011/026845, European Patent Office, dated May 16, 2011, 6 pages.

* cited by examiner

*Primary Examiner* — Elvin G Enad
*Assistant Examiner* — Alexander Talpalatskiy

(57) ABSTRACT

A support for anchoring a trip unit of a circuit breaker to a base thereof to prevent separation of the trip unit from the base during a short circuit fault. The support has top-facing two locking tabs that snap into place behind a wall in a lug-receiving area of the base. The support also has an opening through which a terminal of the trip unit is received snugly. The locking tabs keep the support in place and prevent forces produced by gasses during a fault from forcing the trip unit away from the base. The terminal, attached to the trip unit, is retained by the opening, which transfers upward forces to the top of the support, which is positioned against a top section of the base. The snug fit by the terminal through the opening and retention of the support in the lug-receiving area during a fault increases post-fault dielectric performance.

15 Claims, 7 Drawing Sheets

CIRCUIT BREAKER TRIP UNIT SUPPORT

FIELD OF THE INVENTION

The present disclosure relates generally to circuit breakers, and, more particularly, to a support for anchoring a trip unit to a base of a circuit breaker, such as, for example during an electrical fault.

BACKGROUND

A circuit breaker can include a removable trip unit that trips the circuit breaker in response to an electrical fault, such as a short circuit, thereby disconnecting the circuit breaker from a load that is being protected by the circuit breaker. The removable trip unit is installed into a base of the circuit breaker and screwed or bolted to the base. However, during a short circuit, explosive gasses produce a sudden and immense amount of internal pressure within the circuit breaker, lifting the trip unit from its installed location within the circuit breaker base. The stresses caused by the separation of the trip unit from the base can damage or dislodge the components of the circuit breaker, which can result in mis-operation or failure of the circuit breaker. A need exists for a more reliable support structure that keeps the trip unit on the base of the circuit breaker, such as, for example, during short circuit events.

In addition, during a short circuit fault, debris under high pressure, typically in the form of gas and carbon, is expelled from the inside of the circuit breaker. Exhaust systems are provided for directing much of this debris safely away from the circuit breaker, but inevitably, some debris manages to escape through other areas besides through the exhaust vents. The electrically conductive carbon deposits that accumulate on the breaker near the lugs or wire connectors can form electrical couplings from one pole to another pole, creating a path for electrical current between adjacent lugs or wire connectors. When this occurs, the circuit breaker may fail safety tests. Enhancing the dielectric performance of the circuit breaker following a short circuit fault is desirable. A need exists for more robust dielectric protection following a short circuit fault.

BRIEF SUMMARY

A U-shaped support piece has two tabs protruding from a top of the support and an opening in the back of the support sized to receive an electrical terminal of a trip unit. The support fits snugly into a lug-receiving area of a circuit breaker, where lugs attach cables carrying electrical current to the circuit breaker. The opening of the support is slid over the protruding terminal of the circuit breaker trip unit, and the upper part of the support is pushed against the base until the tabs snap into place behind a wall of the circuit breaker base into which the trip unit is installed. During a short circuit event, the forces created by the gasses try to push the trip unit away from the base, but the terminal of the trip unit is prevented from moving as it tries to push up against the opening of the support. The top of the support in turn pushes against the wall of the base, which keeps the trip unit from separating away from the base.

The support stays in place during a short circuit fault, enhancing the dielectric performance of the circuit breaker when the support is made of a dielectric material, such as plastic. The support provides additional creepage distance between the circuit breaker connectors and other conductive parts of the breaker.

The foregoing and additional aspects and implementations of the present disclosure will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the present disclosure will become apparent upon reading the following detailed description and upon reference to the drawings.

DETAILED DESCRIPTION

Figure 1A:
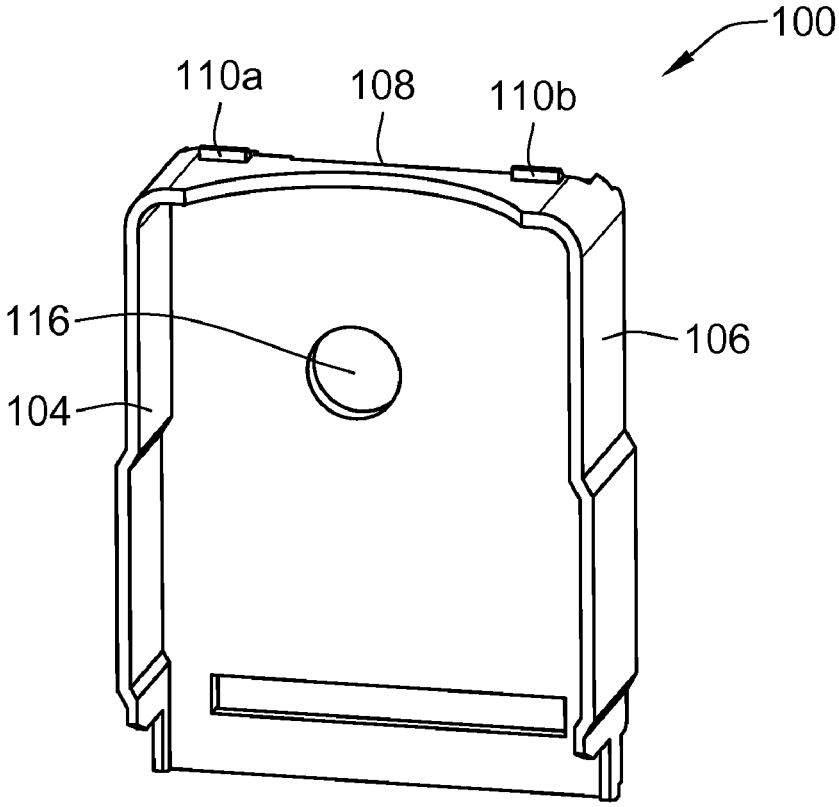
FIG. 1A is a front view of a support according to the present disclosure.
Figure 1B:
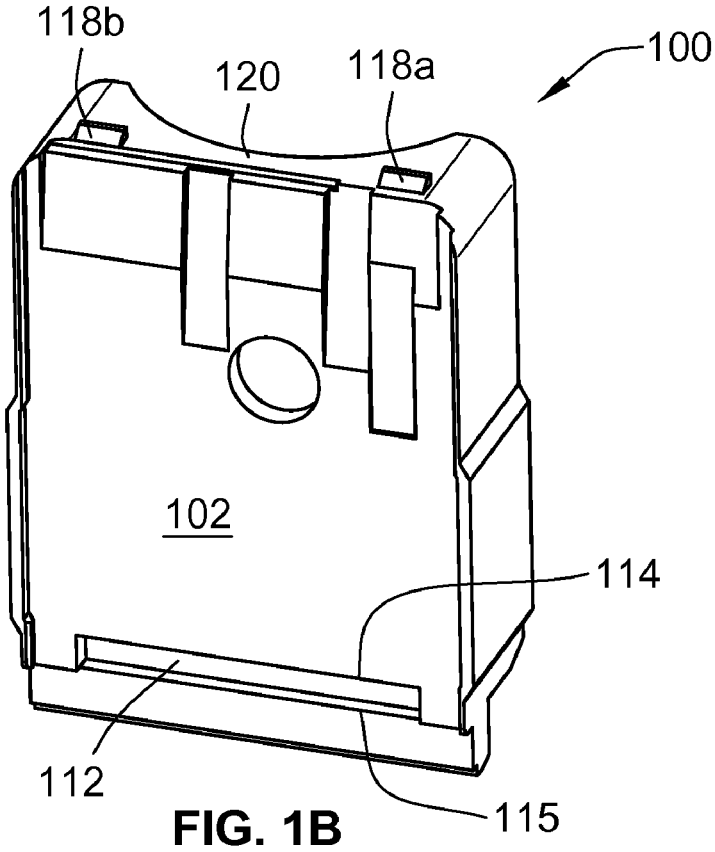
FIG. 1B is a back view of the support shown in FIG. 1A.

FIGS. 1A and 1B illustrate front and back views of a removable support 100 that keeps a removable trip unit of a circuit breaker 200 (FIGS. 2A, 4) from separating away from a base 204 (FIG. 2A) of the circuit breaker 200 and enhances the dielectric performance of the circuit breaker 200 following an electrical fault, such as a short circuit fault. The support 100 includes a back section 102 and oppositely facing wall sections 104, 106 that are positioned against corresponding side walls of a lug-receiving area 208*a* (FIG. 2A) of the circuit breaker 200. The back section 102 and the wall sections 104, 106 form a generally U-shape. Each of the wall sections 104, 106 is orthogonal to the back section 102 of the support 100. The back section 102 is positioned against a corresponding front section 206 (FIG. 2A) of the base 204 of the circuit breaker 200. The support 100 includes a top section 108 having a top surface 120. The top section 108 and the wall sections 104, 106 form a generally U-shaped piece. The top section 108 includes a first tab 110*a* spaced apart from a second tab 110*b*, both of which protrude away from the top surface 120 of the top section 108 of the support 100. The tabs 110*a,b* include a back-sloped surface 118*a,b* (FIGS. 1B, 2B) that slopes away from the back section 102 toward the front section 206 when the support 100 is installed into the lug-receiving area 208*a*. The back-sloped surfaces 118*a,b* allow the tabs 110*a,b* to snap into place behind the wall portion 212 of the base 204 when the support 100 is pushed into the lug-receiving area 208 toward the front section 206 of the base 204. The tabs 110*a,b* are positioned on opposite sides of the top surface 120 of the top section 108 of the support 100 to secure the support 100 against the wall portion 212 at both of the opposite sides of the top surface 120.

Figure 4:
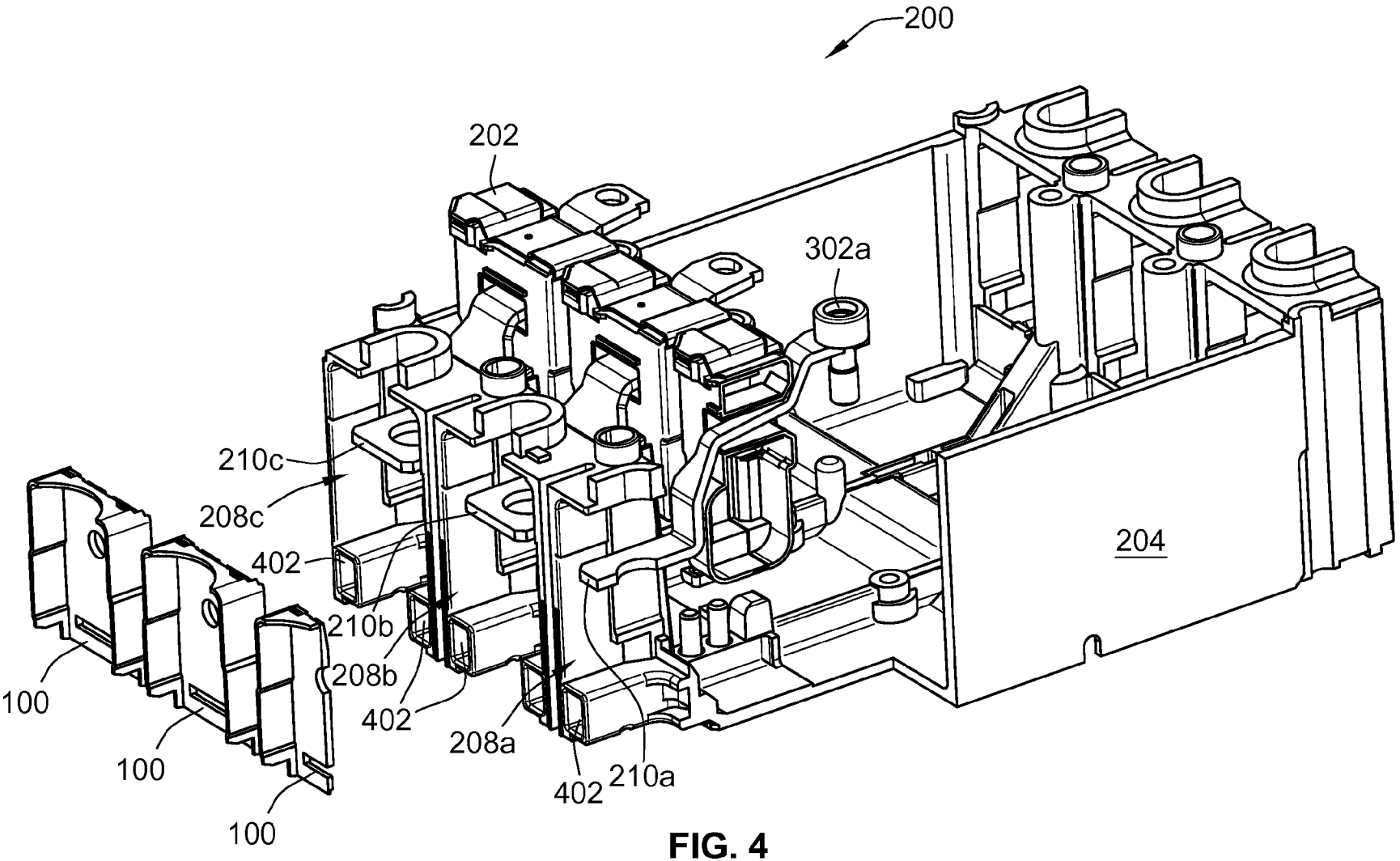
FIG. 4 is a perspective, cut-away view of a 3-pole circuit breaker having three supports like the one shown in FIG. 1A exploded away from the lug-receiving areas of the circuit breaker in ready-to-be-installed positions, and a trip unit partially suspended above the base of the circuit breaker.
Figure 5:
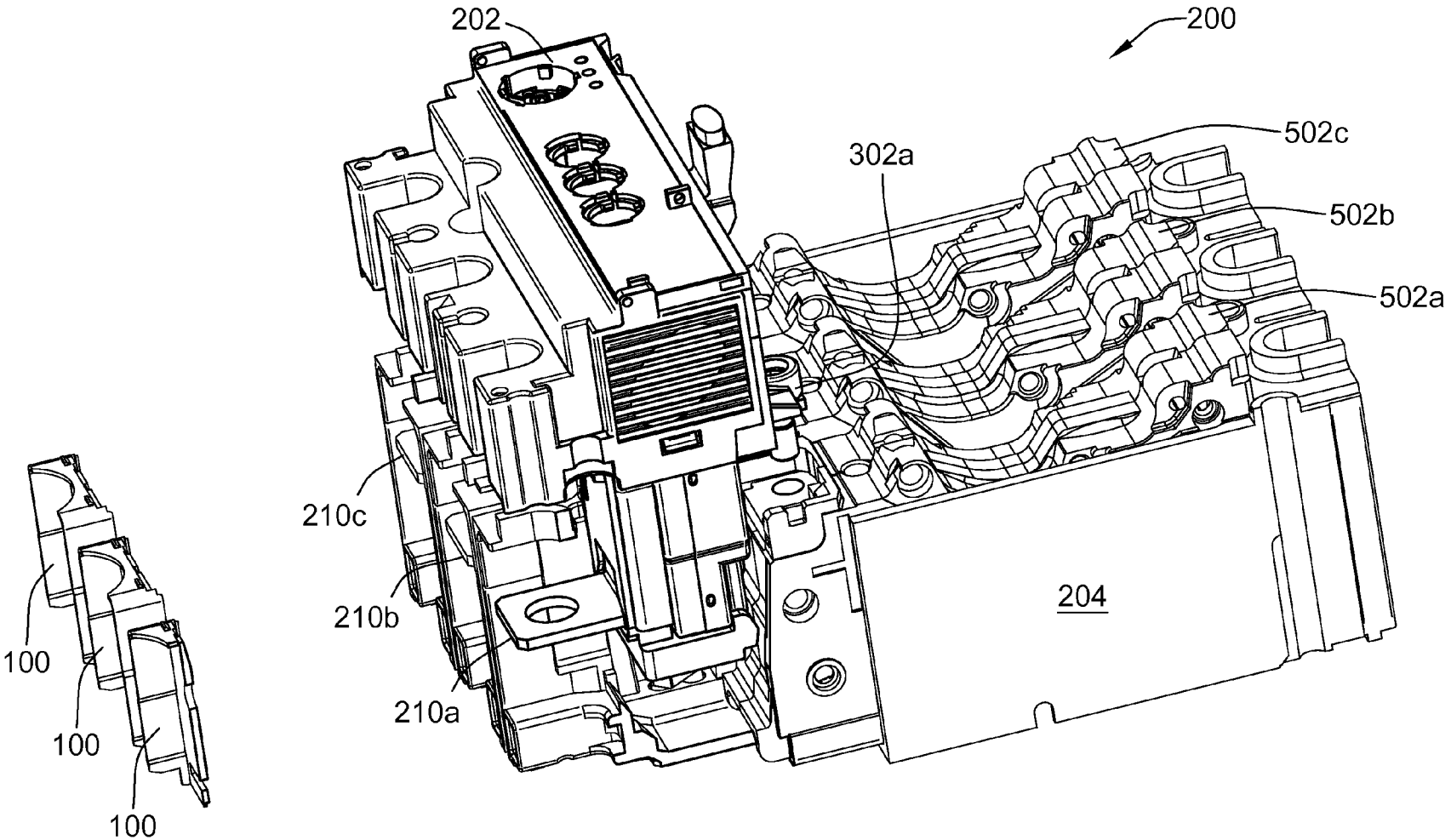
FIG. 5 is a perspective, cut-away view of the circuit breaker shown in FIG. 4 with the trip unit partially suspended above the base of the circuit breaker and the ampoule assemblies to which the terminals of the trip unit are connected.

With reference to FIGS. 4 and 5, the support 100 is made of a dielectric material, such as plastic or other electrically insulating material, for providing an electrically insulating barrier between a lug (not shown) inserted into the lug-receiving area 208*a* of the base 204, or a wire connector (not shown) connected to the terminal 210*a* and the front section 206 of the base 204 against which the back portion 102 of the support 100 is positioned. The dielectric material of the support 100 provides over-surface and through-air clearance between the wire connectors that connect to the lugs installed into the lug-receiving area 208, which enhances dielectric performance between adjacent terminals 210*a,b,c* (FIG. 5) following a short circuit event. During a short circuit fault, debris produced by the fault typically in the form of carbon, is exhausted away from the circuit breaker by exhaust vents 402 (FIG. 4). But some debris can escape through other parts of the circuit breaker 200, including around the trip unit 202 (shown floating above its installed placement). The support 100 provides a dielectric barrier for any such exiting debris. Because the trip unit 202 remains securely anchored to the base 204 during a short circuit fault, no additional openings for the debris are created by the movement of the trip unit 202 away from the base 204.

Figure 2A:
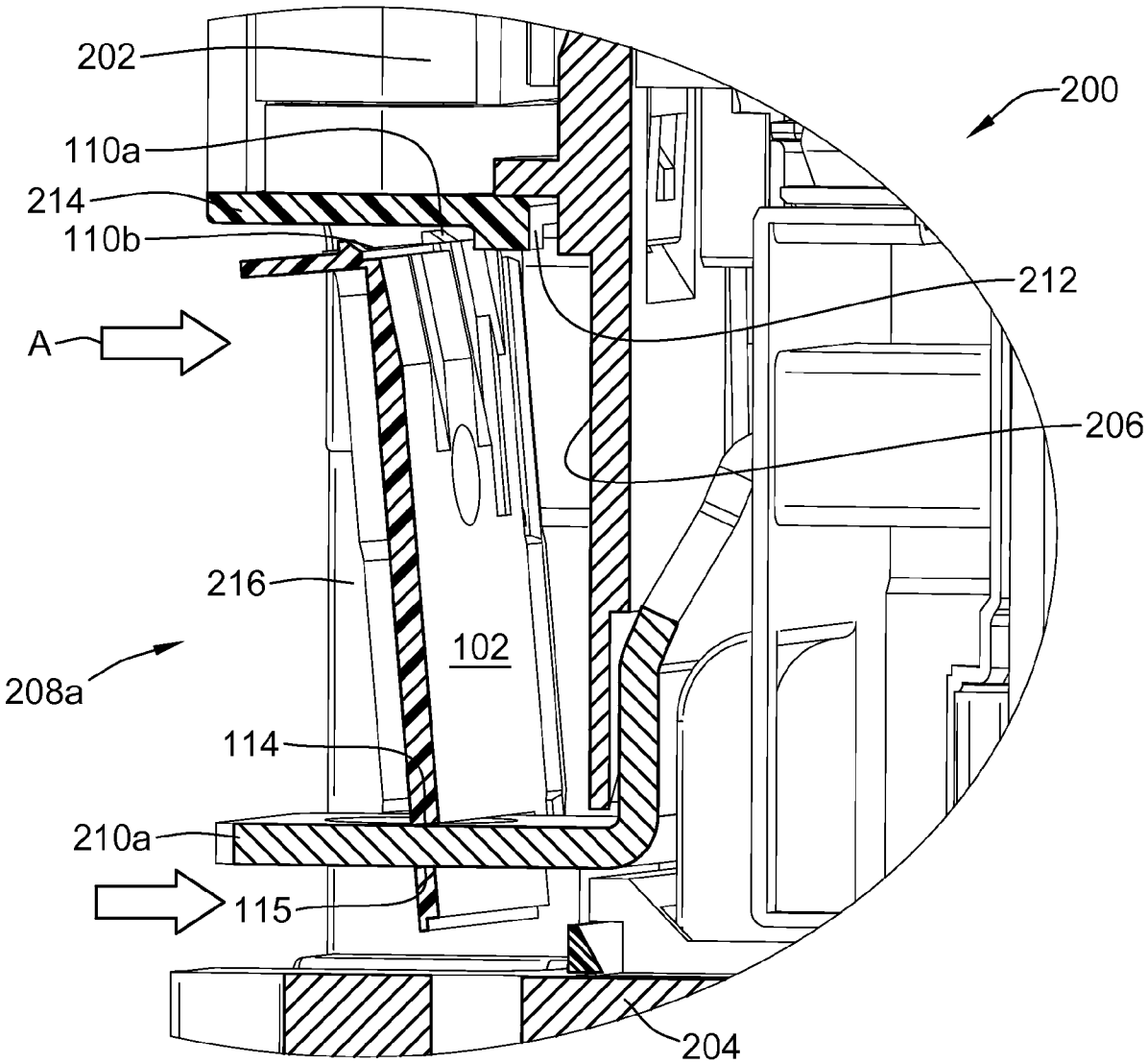
FIG. 2A is a partial, cut-away, cross-sectional, perspective side view of the support shown in FIG. 1A partially installed into a lug-receiving area of a base of a circuit breaker.

The lug-receiving area 208*a* has a generally rectangular shaped access opening, and includes a side wall 216 (FIG. 2A), an oppositely facing side wall 218 (FIG. 3), and a top section 214 (FIG. 2A). The top section 214 terminates at a wall portion 212, against which the tabs 110*a,b* are received.

The support includes a rectangular-shaped opening 112 formed in the back section 102 of the support 100. The opening 112 has dimensions corresponding to a cross-sectional thickness of the electrical terminal 210*a* that extends through the opening 112. By "corresponding to," it is meant that the dimensions are slightly larger than the thickness so that the electrical terminal 210*a* is received snugly with minimal gaps around the opening 112 when the electrical terminal 210*a* is passed therethrough. An upper surface 114 of the back section 102 coincident with the opening 112 in the support 100 contacts a top surface 220 (FIG. 2B) of the electrical terminal 210*a* (FIG. 2A) of the trip unit 202, which extends through the opening 112 of the support 100. Correspondingly, a lower surface 115 of the back section 102 coincident with the opening 112 in the support 100 contacts a bottom surface 221 (FIG. 2B) of the electrical terminal 210*a*. Thus, little to no gap exists between the terminal 210*a* and the back section 100 in the opening 112, presenting a barrier to any debris that is produced during an electrical fault.

The electrical terminal 210*a* is connected to an ampoule assembly 502*a* (FIGS. 5 and 6) of the circuit breaker 200, which includes a movable contact. The back section 102 includes a calibration access screw hole 116 for permitting access to a calibration screw (not shown) in the trip unit for conventionally adjusting a parameter of the trip unit.

The tabs 110*a,b* are received securely against the wall portion 212 of a top section 214 of the base 204 for preventing the removable trip unit 202 from moving away from the base 204 during an electrical fault. During a fault, pressure produced by the sudden gasses force the trip unit 202 upwards away from the base 204. Because the terminal 210*a* is provided with the trip unit 202, the terminal 210*a* wants to move with the trip unit 202. However, the terminal 210*a* first encounters the surface 114 coincident with the opening 112, and pushes up against that surface 114. Those forces are transferred along the back section 102 of the support 100 to the top section 108, which pushes up against the top section 214 of the lug-receiving area 208*a* of the base 204. As a result, the trip unit 202 is securely held in place on the base 204 because the terminal 210*a* of the trip unit 202 is not free to move away from the base 204. The support 100 prevents the trip unit 202 from moving away from the base 204 of the circuit breaker 200. Because the trip unit 202 remains securely in place during an electrical fault, the dielectric performance of the circuit breaker 200 is enhanced because the opportunity for exhausted debris to coat the breaker surfaces is minimized by forcing the debris to find another pathway out of the circuit breaker 200.

The support 100 is positioned in the lug-receiving area 208*a* of the base 204 for receiving a conventional lug (not shown) therein. FIG. 2A illustrates the support 100 partially installed into the lug-receiving area 208*a* of the base 204 and slightly twisted toward the viewer for ease of illustration to show the tabs 110*a,b* of the support 100. In practice, the support 100 should be installed by positioning the back section 102 so that it is parallel with the front section 206 of the base 204. The opening 112 of the support 100 is aligned with the terminal 210*a* that is received in the opening 112 as the support 100 is pushed toward the front section 206 of the base 204.

Figure 2B:
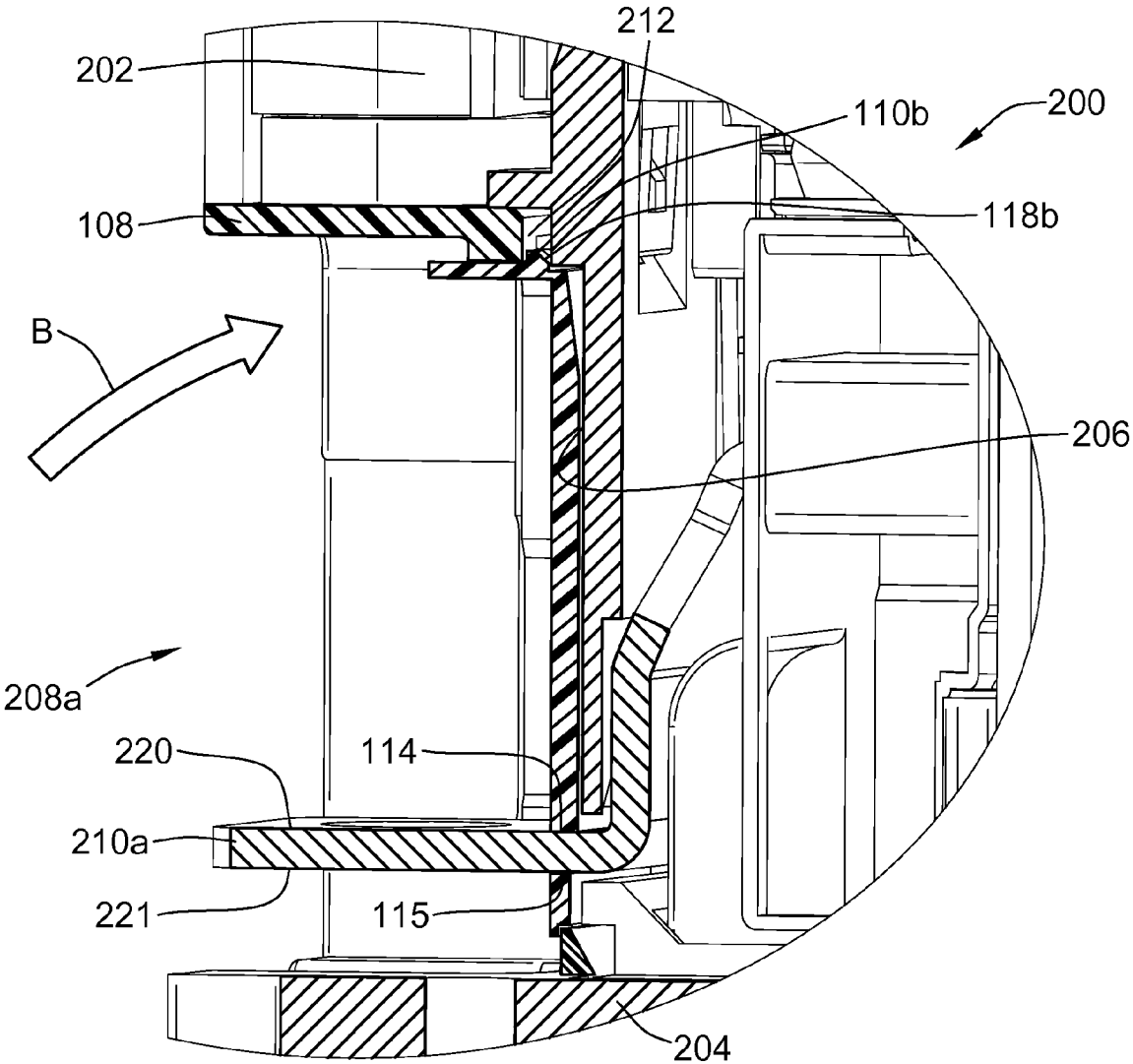
FIG. 2B is a partial, cut-away, cross-sectional, perspective side view of the support shown in FIG. 1A installed into the lug-receiving area of the base.

In FIG. 2B, the support 100 is shown installed into the lug-receiving area 208*a* of the base 204. The tab 110*b* is shown positioned behind the wall portion 212 of the base 204, and the surface 114 of the support 100 contacts the upper surface of the terminal 210*a*. Any force that tries to move the terminal 210*a* (and correspondingly the trip unit 202 to which the terminal 210*a* is attached) away from the base 204 will be opposed by the surface 114 of the support 100, the top section 108 of the support 100, and the top section 214 of the base 204. In this installed position, the back section 102 of the support 100 is positioned against the front section 206 of the lug-receiving area 208*a* of the base 204. The top surface 120 of the support 100 is positioned against the top section 214 of the lug-receiving area 208*a* of the base 204, the tabs 110*a,b* are positioned against the wall portion 212 of the base 204, and the surface 114 of the back section 102 coincident with the opening 112 of the support 100 is positioned against and contacts the top surface 220 of the terminal 210*a*.

Figure 3:
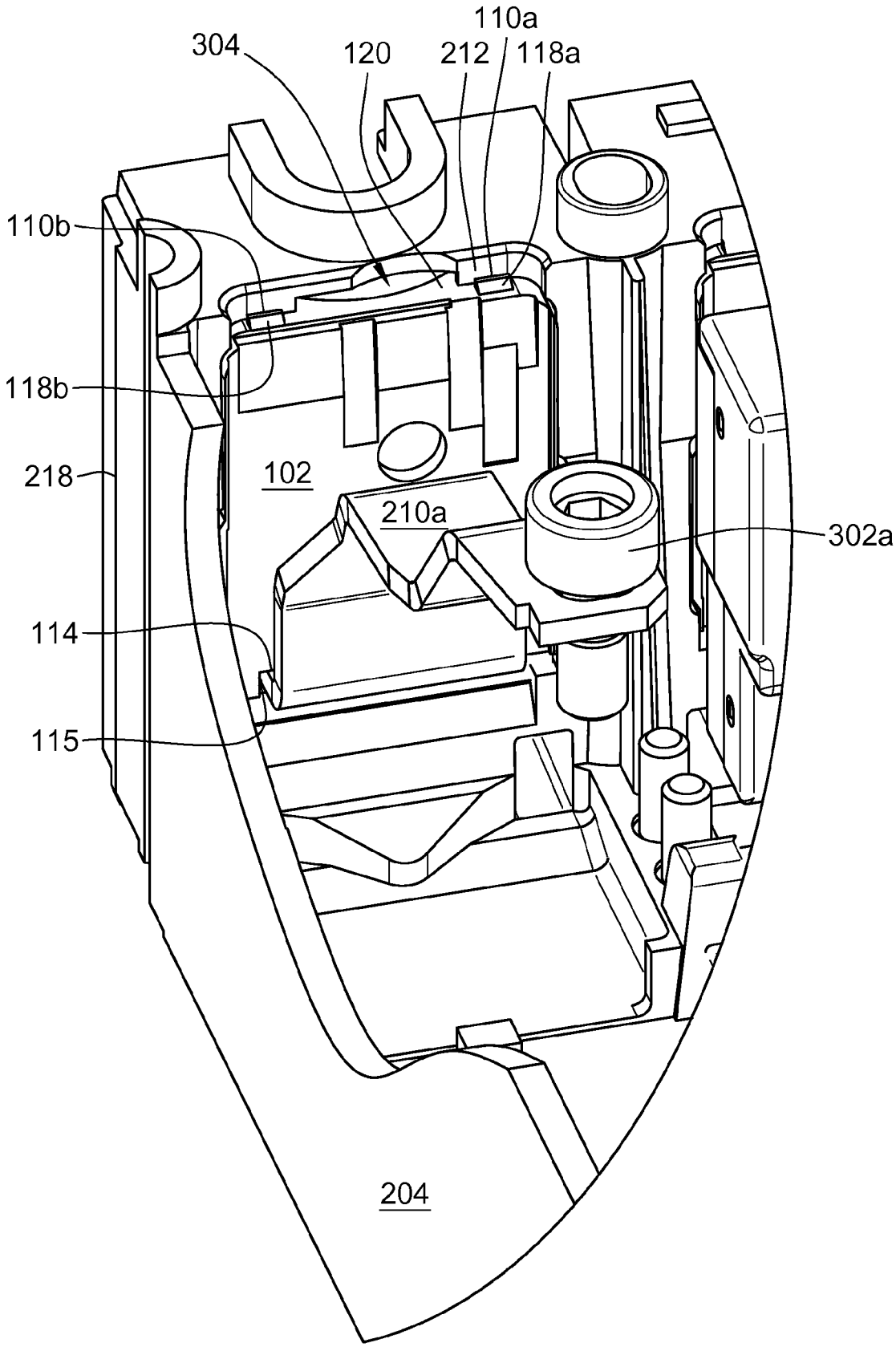
FIG. 3 is a partial, cut-away, top perspective view of a rear of the support shown in FIG. 1A as installed into the lug-receiving area of the base.

FIG. 3 illustrates a cut-away perspective view of a rear portion of the circuit breaker 200 to reveal the tabs 110*a,b* positioned against the wall portion 212 of the base 204. The terminal 210*a*, which can be connected to an electrical load (not shown) terminates in the interior of the circuit breaker 200 and receives a trip-unit-to-ampoule screw 302*a*, which attaches the trip unit 202 to an ampoule assembly 502*a* (FIG. 5). The front section 206 (FIG. 2B) of the base has been removed to show the back section 102 of the support 100 installed within the lug-receiving area 208*a*. The back-sloped surfaces 118*a,b* of the tabs 110*a,b* can be seen as well in this view, and these sloped surfaces allow the tabs 110*a,b* to be snapped into place behind the wall portion 212 of the base 204. To remove the support 100, a screwdriver or similar tool can be inserted into a gap 304 between the top surface 120 of the support 100 and the top section 214 of the lug-receiving area 208*a*, and pressed downward slightly to release the tabs 110*a,b* from the wall portion 212 of the base 204. Once the supports 100 are removed from the lug-receiving areas 208, the trip unit can be removed from the base.

FIG. 4 illustrates a partially cut-away three-pole circuit breaker 200 with three supports 100, one for each pole. Each support 100 is like the support 100 illustrated and described in connection with FIGS. 1A-1B. The ampoule assemblies and other internal components of the circuit breaker 200 and the trip unit 202 have been removed for ease of illustration. A portion of the base 204 is cut-away to reveal part of the trip unit 202. There are three lug-receiving areas 208*a,b,c*, each receiving a corresponding electrical terminal 210*a,b,c* of the trip unit 202. Typically, these terminals 210*a,b,c* are connected to a load (not shown) protected by the circuit breaker 200, and can be called load terminals. Wired connections (including cable conductors) are attached through lugs (not shown) installed into the lug-receiving areas 210*a,b,c* to the terminals 210*a,b,c* for carrying electrical current to the load being protected by the circuit breaker 200.

In FIG. 5, more details of the circuit breaker 200 are shown, including the trip unit 202 and three ampoule assemblies 502*a,b,c*. Each ampoule assembly 502,*a,b,c* is connected to a respective terminal 210*a,b,c* of the trip unit. Each ampoule assembly 502*a,b,c* conventionally includes a movable contact and a stationary contact, which separate from one another upon detection of an electrical fault by the circuit breaker 200 to break the electrical connection between the load side of the circuit breaker and the line side of the circuit breaker, disconnecting the load from line current being supplied by the line side (or vice versa). The trip unit 202 is shown slightly elevated over the base 204 in an intermediate installed position. To install the trip unit 202, it is positioned into the base 204, and the screws 302 (FIG. 6) are screwed into the ampoules 502, which in turn are securely coupled to the base 204.

Figure 6:
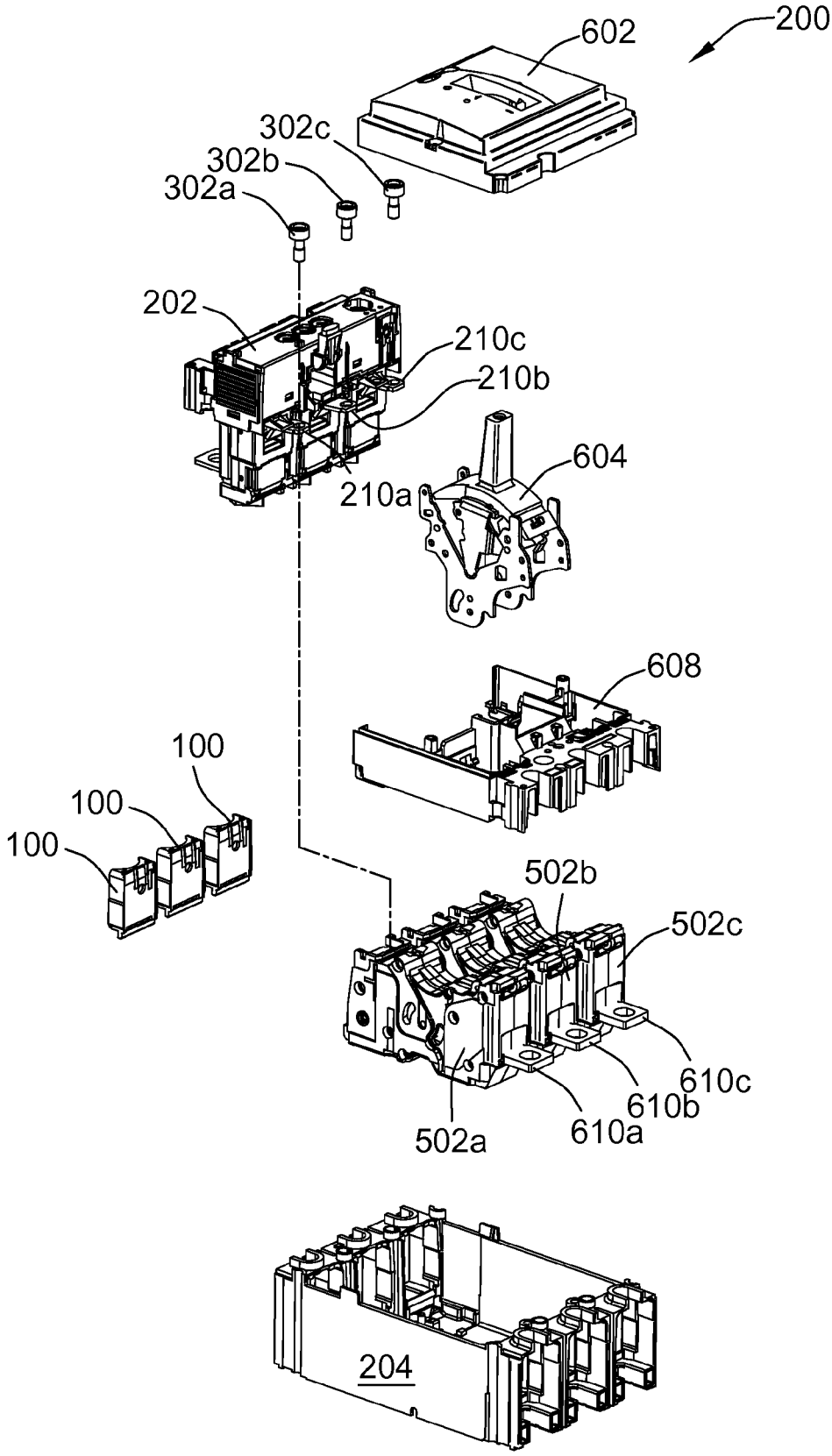
FIG. 6 is an exploded view of the circuit breaker shown in FIG. 5.

FIG. 6 is an exploded perspective view of some of the primary components of the circuit breaker 200. An auxiliary cover 602 is placed over a handle 604. A pressure cover 608 is placed adjacent to the ampoule assemblies 502*a,b,c*, which have corresponding line terminals 610*a,b,c* for connection to a respective phase of a conductor carrying current from a power supply. To install the trip unit 202 into the circuit breaker 200, the trip unit 202 is lowered into the base 204, and the screws 302*a,b,c* are screwed into the respective ampoule assemblies 502*a,b,c*, which are in turn securely coupled to the base 204, optionally through a piston trip assembly (not shown). Then, three supports 100 are installed into the corresponding lug-receiving areas 208 of the base 204 until they snap in place.

Although the support 100 has been described as being composed of a dielectric material, in other implementations in which it is not needed as a dielectric, the support 100 can be made of metal, such as steel. Instead of being inserted into the trip unit end of the circuit breaker, they can be installed into area where the line terminals 610 are attached to the ampoules 502. Finally, the support 100 is not necessarily for use only during an electrical fault. It can be generally used to secure the major, separate components of the circuit breaker together, such as the trip unit, base, and ampoules, inhibiting these major components from separating away from one another.

While particular implementations and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

What is claimed is:

1. A removable support for retaining a trip unit of a circuit breaker to a base of the circuit breaker, comprising:

a back section for positioning against a corresponding front section of a lug-receiving area of the base of the circuit breaker;

a pair of oppositely facing wall sections for positioning against corresponding oppositely facing side walls of the lug-receiving area;

a top section adjacent to the back section and to the wall sections; and a tab that protrudes away from a surface of the support;

wherein the back section includes an opening, wherein a surface of the back section, coincident with the opening, contacts an electrical terminal that extends through the opening, the electrical terminal operable to connect to an ampoule assembly inside the circuit breaker, wherein the tab is configured to be received securely against a wall portion of the base for preventing the removable trip unit from moving away from the base during an electrical fault.

2. The support of claim 1, wherein the support is positioned in the lug-receiving area of the base, the lug-receiving area being operable to receive a lug therein, the lug-receiving area having a top section against which the top section of the support is positioned, the top section of the lug-receiving area including the wall portion against which the tab is securely received.

3. The support of claim 1, further comprising a calibration screw access hole in the back section for permitting access to a calibration screw in the trip unit.

4. The support of claim 1, wherein the wall sections and the top section form a generally U-shape.

5. The support of claim 1, wherein the opening has a generally rectangular shape and has dimensions corresponding to a cross-sectional thickness of the electrical terminal that extends through the opening.

6. The support of claim 1, wherein the tab includes a back-sloped surface that opposes the wall portion of the base.

7. The support of claim 1, further comprising a second tab that protrudes away from the top surface of the top section and configured to be received securely against the wall portion of the base.

8. The support of claim 7, wherein the tab and the second tab are spaced apart on opposite sides of the top surface of the top section to secure the support against the wall portion at both of the opposite sides of the top surface.

9. The support of claim 1, wherein the support is made of a dielectric material for providing an electrically insulating barrier between a lug inserted into a lug receiving area of the base and the front section of the base against which the back portion of the support is positioned.

10. A circuit breaker, comprising:

a trip unit having an electrical terminal;

a base to which the trip unit is secured, the base including a lug-receiving area for receiving a lug through which the electrical terminal of the trip unit is received;

a support having a back section, oppositely facing wall sections, a top section, and a tab protruding away from a surface of the support, the back section including an opening, the electrical terminal extending through the opening and contacting a surface of the back section coincident with the opening, wherein the tab is operable to be positioned against a wall portion of the base for inhibiting the trip unit from moving away from the base during an electrical fault.

11. The circuit breaker of claim 10, wherein the support is positioned in the lug-receiving area of the base, the lug-receiving area being operable to receive the lug therein, the lug-receiving area having a top section against which the top section of the support is positioned, the top section of the lug-receiving area including the wall portion, the tab abutting against the wall portion.

12. The circuit breaker of claim 10, wherein the opening has a generally rectangular shape and has dimensions corresponding to a cross-sectional thickness of the electrical terminal.

13. The circuit breaker of claim 12, wherein the opening is dimensioned to inhibit debris produced by the electrical fault from exiting the opening.

14. The circuit breaker of claim 10, wherein the tab includes a back-sloped surface that opposes the wall portion of the base.

15. The circuit breaker of claim 10, wherein the trip unit further includes a second electrical terminal adjacent to the electrical terminal and a third electrical terminal adjacent to the second electrical terminal, the electrical terminals for connection to respective ampoule assemblies in the base of the circuit breaker, the base further including a second lug-receiving area adjacent to the lug receiving area and a third lug-receiving area adjacent to the second lug-receiving area, the support being made of a dielectric material, the support operable to prevent debris produced by the electrical fault from accumulating across the lug-receiving area and the second lug-receiving area, the ampoule assemblies including a movable contact that separates from a stationary contact for electrically disconnecting a load protected by the circuit breaker from line current supplied to the circuit breaker.

* * * * *